US012576482B2

(12) United States Patent
Mahli et al.

(10) Patent No.: US 12,576,482 B2
(45) Date of Patent: Mar. 17, 2026

(54) POROUS COATED ABRASIVE ARTICLE AND METHOD OF MAKING THE SAME

(71) Applicant: 3M INNOVATIVE PROPERTIES COMPANY, St. Paul, MN (US)

(72) Inventors: David M. Mahli, Woodbury, MN (US); Joel A. Getschel, Osceola, WI (US); Paul D. Graham, Woodbury, MN (US); Steven J. McMan, Stillwater, MN (US); Thomas A. Mahler, Osceola, WI (US); Charles R. Wald, Oakdale, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 615 days.

(21) Appl. No.: 17/998,962

(22) PCT Filed: May 6, 2021

(86) PCT No.: PCT/IB2021/053842
§ 371 (c)(1),
(2) Date: Nov. 16, 2022

(87) PCT Pub. No.: WO2021/234494
PCT Pub. Date: Nov. 25, 2021

(65) Prior Publication Data

US 2023/0226665 A1 Jul. 20, 2023

Related U.S. Application Data

(60) Provisional application No. 63/026,986, filed on May 19, 2020.

(51) Int. Cl.

| | |
|---|---|
| ***B24D 18/00*** | (2006.01) |
| ***B24D 11/00*** | (2006.01) |
| ***B24D 11/02*** | (2006.01) |

(52) U.S. Cl.
CPC ..... *B24D 18/0072* (2013.01); *B24D 11/005* (2013.01); *B24D 11/02* (2013.01)

(58) Field of Classification Search
CPC .... B24D 18/0072; B24D 11/005; B24D 11/02
(Continued)

(56) References Cited

U.S. PATENT DOCUMENTS

| | | | |
|---|---|---|---|
| 3,012,918 | A | 12/1961 | Schaar |
| 3,121,021 | A | 2/1964 | Copeland et al. |

(Continued)

FOREIGN PATENT DOCUMENTS

| | | | |
|---|---|---|---|
| CA | 2887481 | A1 | 1/2019 |
| CN | 106497489 | A | 3/2017 |

(Continued)

OTHER PUBLICATIONS

International Search Report for PCT Application No. PCT/IB2021/053842, mailed on Aug. 11, 2021, 5 pages.

*Primary Examiner* — James E McDonough
(74) *Attorney, Agent, or Firm* — Kathleen B. Gross; Bradford B. Wright; Katherine M. Scholz

(57) ABSTRACT

A porous coated abrasive article comprises a porous backing having opposed first and second major surfaces, and a porous abrasive layer disposed on the first major surface. The porous backing comprises a porous oriented thermoplastic film. The porous backing has a land portion and openings extending between the first and second major surfaces. Each opening has a respective area at the first surface, wherein the openings have a number density of 5 to 4600 openings per square inch, and wherein the total area of the openings is from 1 to 90 area percent, based on the combined total areas of the land portion and the openings. The porous abrasive layer is disposed on the first major surface of the porous backing. The porous abrasive layer
(Continued)

comprises abrasive particles retained in a binder and has an abrading surface opposite the porous backing, and the second major surface of the porous backing and the abrading surface are in fluid communication through at least some of the openings. A method of making the porous coated abrasive article using flame perforation is also disclosed.

20 Claims, 1 Drawing Sheet

(58) Field of Classification Search
USPC ..... 51/293, 295
See application file for complete search history.

(56) References Cited

U.S. PATENT DOCUMENTS

| | | | |
|---|---|---|---|
| 3,394,211 | A | 7/1968 | Macduff |
| 3,908,650 | A | 9/1975 | Dunshee et al. |
| 4,655,210 | A | 4/1987 | Edenbaum et al. |
| 4,734,104 | A | 3/1988 | Broberg |
| 4,737,163 | A | 4/1988 | Larkey |
| 4,751,138 | A | 6/1988 | Tumey et al. |
| 4,894,060 | A | 1/1990 | Nestegard |
| 4,906,240 | A | 3/1990 | Reed et al. |
| 5,049,417 | A | 9/1991 | Tsubota et al. |
| 5,058,247 | A | 10/1991 | Thomas et al. |
| 5,152,917 | A | 10/1992 | Pieper et al. |
| 5,203,884 | A | 4/1993 | Buchanan et al. |
| 5,378,251 | A | 1/1995 | Culler et al. |
| 5,417,726 | A | 5/1995 | Stout et al. |
| 5,435,816 | A | 7/1995 | Spurgeon et al. |
| 5,436,063 | A | 7/1995 | Follett et al. |
| 5,454,844 | A | 10/1995 | Hibbard et al. |
| 5,496,386 | A | 3/1996 | Broberg et al. |
| 5,520,711 | A | 5/1996 | Helmin |
| 5,556,437 | A | 9/1996 | Lee et al. |
| 5,609,706 | A | 3/1997 | Benedict et al. |
| 5,641,506 | A | 6/1997 | Talke et al. |
| 5,672,097 | A | 9/1997 | Hoopman et al. |
| 5,679,302 | A | 10/1997 | Miller et al. |
| 5,681,217 | A | 10/1997 | Hoopman et al. |
| 5,766,277 | A | 6/1998 | Devoe et al. |
| 5,810,756 | A | 9/1998 | Montecalvo et al. |
| 5,833,724 | A | 11/1998 | Wei et al. |
| 5,851,247 | A | 12/1998 | Stoetzel et al. |
| 5,863,306 | A | 1/1999 | Wei et al. |
| 5,891,967 | A | 4/1999 | Strobel et al. |
| 5,908,476 | A | 6/1999 | Nishio et al. |
| 5,954,844 | A | 9/1999 | Law et al. |
| 5,961,674 | A | 10/1999 | Gagliardi et al. |
| 5,975,988 | A | 11/1999 | Christianson |
| 6,048,375 | A | 4/2000 | Yang et al. |
| 6,077,601 | A | 6/2000 | Devoe et al. |
| 6,139,594 | A | 10/2000 | Kincaid et al. |
| 6,221,484 | B1 | 4/2001 | Leiter |
| 6,228,133 | B1 | 5/2001 | Thurber et al. |
| 6,228,485 | B1 | 5/2001 | Leiter |
| 6,293,980 | B2 | 9/2001 | Wei et al. |
| 6,579,161 | B1 | 6/2003 | Chesley et al. |
| 6,635,334 | B1 | 10/2003 | Jackson et al. |
| 7,037,100 | B2 | 5/2006 | Strobel et al. |
| 7,452,265 | B2 | 11/2008 | Rambosek et al. |
| 8,038,750 | B2 | 10/2011 | Pribyl et al. |
| 8,142,531 | B2 | 3/2012 | Adefris et al. |
| 9,393,673 | B2 | 7/2016 | Eilers et al. |
| 9,562,173 | B2 | 2/2017 | Jeon et al. |
| 9,810,641 | B2 | 11/2017 | Sood et al. |
| 11,865,673 | B2 * | 1/2024 | Jangu ..... B24D 3/28 |
| 2001/0041511 | A1 | 11/2001 | Lack et al. |
| 2004/0170801 | A1 | 9/2004 | Seth et al. |
| 2007/0227653 | A1 | 10/2007 | Tsuda et al. |
| 2008/0233850 | A1 | 9/2008 | Woo et al. |
| 2009/0022927 | A1 | 1/2009 | Strobel et al. |
| 2009/0092819 | A1 | 4/2009 | Malik et al. |
| 2015/0024159 | A1 | 1/2015 | Bess et al. |
| 2016/0346422 | A1 | 12/2016 | Watanabe et al. |

FOREIGN PATENT DOCUMENTS

| | | | |
|---|---|---|---|
| GB | 851053 | A | 10/1960 |
| GB | 854473 | A | 11/1960 |
| GB | 1012963 | A | 12/1965 |
| GB | 1083847 | A | 9/1967 |
| TW | 201414563 | A | 4/2014 |
| WO | 2015100319 | A1 | 7/2015 |
| WO | 2015168229 | A1 | 11/2015 |
| WO | 2016105501 | A1 | 6/2016 |
| WO | 2019120211 | A1 | 6/2019 |

* cited by examiner

POROUS COATED ABRASIVE ARTICLE AND METHOD OF MAKING THE SAME

CROSS-REFERENCE TO RELATED APPLICATIONS

This application is a national stage filing under 35 U.S.C. 371 of PCT/IB2021/053842, filed May 6, 2021, which claims the benefit of Provisional Application No. 63/026,986, filed May 19, 2020.

TECHNICAL FIELD

The present disclosure broadly relates to coated abrasive articles and method of making and using the same.

BACKGROUND

Coated abrasive articles generally include an abrasive layer disposed on a porous backing. They are used in industry for abrading, grinding, and polishing applications. They may be obtained in a variety of converted forms such as, for example, belts, discs, and sheets, in many different sizes. In use, they typically generate swarf. The term "swarf" as used herein refers to loose material such as dust and debris generated during abrading processes, and which may become airborne and/or build-up on the abrading surface of the abrasive article. Swarf may present a nuisance (e.g., in autobody shop where cleanliness is key during painting) and/or a hazard depending on the material being abraded (e.g., chromated aircraft parts). Removing swarf from the abrading surface of the abrasive layer is also known to often improve the performance of coated abrasive articles. In such cases, efficient swarf extraction typically relies on porosity of the coated abrasive article.

In such situations, a porous coated abrasive article (e.g., a perforated film-backed abrasive disc or sheet) is often mounted on an abrasive tool having vacuum suction that is capable of removing most or all the swarf. The tool may have a mechanical fastener component such as, for example, the hooked portion of a hook and loop fastening system that engages a looped porous backing secured to the back side (i.e., opposite the abrasive layer) of the porous coated abrasive article.

SUMMARY

Attachment interface layers (e.g., a looped knit fabric) are commonly bonded to abrasive backings using a laminating adhesive. If the adhesive is a hot-melt film, it can reduce swarf removal by blocking the openings through the coated abrasive article. The resulting material is not breathable and has poor dust extraction performance. On the other hand, mechanical perforating operations after adhesive bonding can have adhesive build up problems on the perforating equipment and/or abrasive article, and generate scrap. The present inventors have found that these problems can be effectively eliminated by perforating oriented thermoplastic films and coating them with an abrasive layer to provide porous film-backed coated abrasive articles using a perforation technique in which a thermoplastic film backing and optionally a laminating adhesive film are perforated using a flame perforation technique.

Advantageously, in those embodiments where flame perforation is used to make the openings, porous coated abrasive articles according to the present disclosure can have perforation densities well in excess of those generally practiced in the art. Moreover, they can be made by methods that do not generate appreciable amounts of scrap material or gaseous byproducts during manufacture of the openings. And the methods are typically rapid and inexpensive.

Accordingly, in one aspect, the present disclosure provides a porous coated abrasive article comprising:

a porous backing having opposed first and second major surfaces, wherein the porous backing comprises a porous oriented thermoplastic film, wherein the porous backing has a land portion and openings extending between the first and second major surfaces, wherein each opening has a respective area at the first major surface, wherein the openings have a number density of 5 to 4600 openings per square inch, and wherein the total area of the openings is from 1 to 90 area percent, based on the combined total areas of the land portion and the openings; and a porous abrasive layer disposed on the first major surface of the porous backing, wherein the porous abrasive layer comprises abrasive particles retained in a binder and has an abrading surface opposite the porous backing, and wherein the second major surface of the porous backing and the abrading surface are in fluid communication through at least some of the openings.

In another aspect, the present disclosure provides a method of making a porous coated abrasive article, the method comprising:

providing a porous backing having opposed first and second major surfaces, wherein the porous backing comprises a porous oriented thermoplastic film, wherein the porous backing has a land portion and openings extending between the first and second major surfaces, wherein each opening has a respective area at the first surface, wherein the openings have a number density of 5 to 4600 openings per square inch, and wherein the total area of the openings is from 1 to 90 area percent, based on the combined total areas of the land portion and the openings;

disposing a precursor abrasive layer on the first major surface of the porous backing, wherein the precursor abrasive layer comprises abrasive particles dispersed in a curable binder precursor, and at least partially curing the curable binder precursor to provide a binder thereby providing a porous abrasive layer having an abrading surface, wherein the second major surface of the porous backing and the abrading surface are in fluid communication through at least some of the openings.

Features and advantages of the present disclosure will be further understood upon consideration of the detailed description as well as the appended claims.

Figure 1:
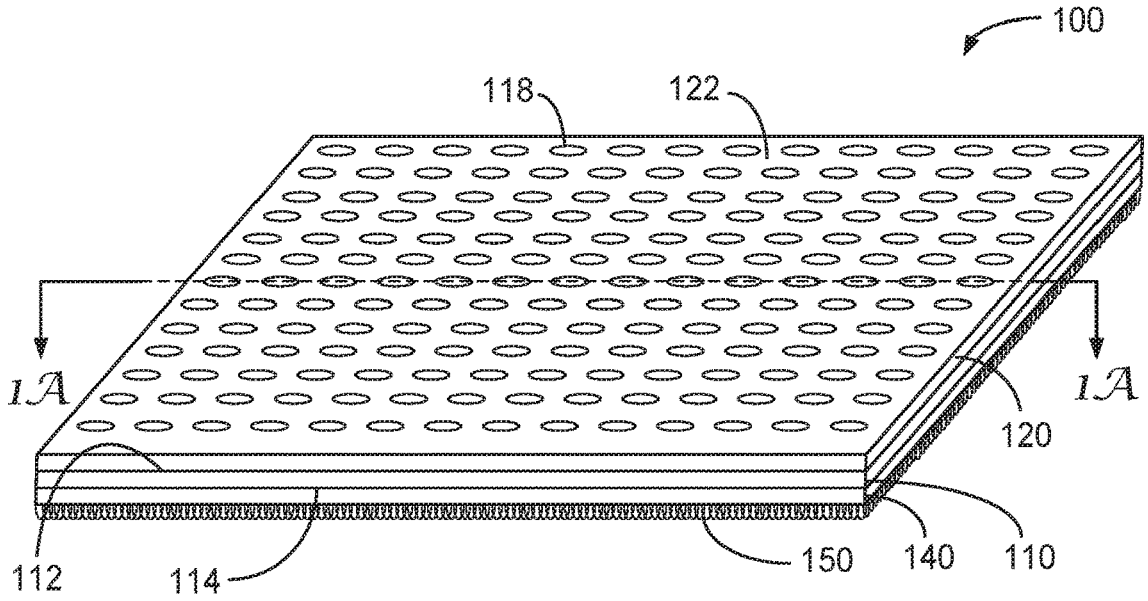
FIG. 1 is a schematic perspective view of exemplary porous coated abrasive article 100.

Repeated use of reference characters in the specification and drawings is intended to represent the same or analogous features or elements of the disclosure. It should be understood that numerous other modifications and embodiments can be devised by those skilled in the art, which fall within the scope and spirit of the principles of the disclosure. The figures may not be drawn to scale.

DETAILED DESCRIPTION

Figure 1A:
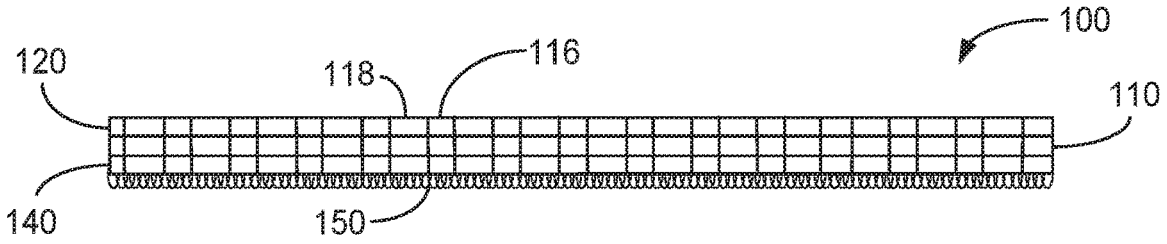
FIG. 1A is a schematic cross-sectional side view of exemplary porous coated abrasive article 100 along line 1A-1A.

Referring now to FIGS. 1 and 1A, exemplary porous coated abrasive article 100 comprises a porous oriented thermoplastic film backing 110 having opposed first and second major surfaces (112, 114). Porous oriented thermoplastic film backing 110 has a land portion 116 and openings 118 extending between the first and second major surfaces. Porous abrasive layer 120 is disposed on the first major surface 112 of film porous oriented thermoplastic film backing 110. Porous abrasive layer 120 comprises abrasive particles (not shown) retained in a binder (not shown) and has an abrading surface 122 opposite the porous backing 110. The second major surface 114 of the porous oriented thermoplastic film backing 110 and the abrading surface 122 are in fluid communication through at least some of the openings. Optional porous adhesive layer 140 is disposed on the second major surface 114 of the porous backing. Porous attachment interface layer 150 (shown as a looped fabric) is adhesively bonded to optional porous adhesive layer 140.

Good air flow through the porous coated abrasive article is important to proper function. Accordingly, the openings have a number (i.e., of openings) density of 5 to 4600 openings per square inch (0.75 to 715 openings per square centimeter), preferably 10 to 4100 openings per square inch (1.5 to 640 openings per square centimeter), more preferably 50 to 4100 openings per square inch (7.8 to 640 openings per square centimeter), and more preferably 50 to 160 openings per square inch (7.8 to openings per square centimeter). Likewise, at the first surface (which includes the land portion and the openings) the combined total area of the openings is 1 to 90 percent based on the total area of the first surface, preferably the combined total area of the openings is 5 to 80 percent based on the total area of the first surface, and more preferably the combined total area of the openings is 20 to 80 percent based on the total area of the first surface. It is envisaged that the foregoing densities and area ranges may be used in any combination thereof.

The second major surface of the porous backing and the abrading surface are in fluid communication through at least 30, 40, 50, 60, 70, 80, or even at least 90 percent of the openings. Likewise, the openings may extend thicknesswise through the coated abrasive article or any subcombination thereof (e.g., from the abrading surface through the optional porous adhesive layer or even through and optional porous attachment interface layer). It is noted that the second and first surfaces of the porous backing will often be covered with various layers of material; however, the surfaces are still accessible within the openings in the porous backing.

The porous abrasive layer comprises abrasive particles retained in a binder. It is typically prepared by coating a precursor abrasive layer comprising the abrasive particles dispersed in a corresponding binder precursor that is subsequently sufficiently hardened to form the binder, however, this is not a requirement. In some embodiments, the porous abrasive layer comprises shaped abrasive composites. Shaped (as used herein "intentionally shaped") abrasive composites comprise the abrasive particles retained in the binder. Many shaped abrasive composites, including also precisely-shaped abrasive composites, are known in the abrasive arts. Openings/perforations may be formed in the porous backing prior to coating the precursor abrasive layer on the first surface of the backing. In this case, the precursor abrasive layer should preferably not completely bridge at least a majority of the openings, thereby leaving at least some, and preferably substantially all of the openings unobstructed so that swarf may be removed to the vacuum source. It is possible, however, that the precursor abrasive layer may encroach into and/or over the edges of the openings to a minor degree without causing appreciable performance degradation.

The porous backing comprises a porous oriented thermoplastic film. This may be generally provided by forming openings in an oriented thermoplastic film. The openings may be formed by any known method including, for example, mechanical perforation, laser perforation, and flame-perforation. Of these, flame perforation is preferred due to its low cost and relatively higher speed.

Briefly, the flame perforation process uses a nipped film between a female-patterned cool backing roll, and a laminar pre-mixed natural gas-air flame. Typically, this process is used to create holes/rims on/in oriented films. The female pattern backing roll creates pockets where the film is not actively cooled by the backing roll, thus creating local hotspots on the film. The oriented films have internal stresses built in during the orientation process. The hotspots created during the flame perforation results in heat induced stress relaxation which creates open holes surrounded by raised rims in the film which may be on either or both surfaces of the film.

Variations of this general process have been described in, for example, U.S. Pat. No. 3,012,918 (Schaar) and British Pat. Nos. GB 851,053 and GB 854,473, which all generally describe processes and apparatuses for improving the heat-sealability of polymeric films by passing the film over a cooled, hollow, rotating, metal cylinder or support roll with a desired perforation pattern while a jet of gas-heated air is directed onto the surface of the film so that specific areas of the film are melted, forming a pattern of perforations. The preferred linear speed of the film/web during the process is between 4-33 yards per minute. The apparatus in Schaar also includes a cooling jet of air directed at the cylinder surface, operating to maintain the surface temperature of the cylinder between 55 to 70° C.

U.S. Pat. No. 3,394,211 discloses flame perforation of heat-shrinkable, biaxially oriented polypropylene films using a method and apparatus similar to U.S. Pat. No. 3,012,918 (Schaar) with the improvement of restraining the edges of the film by either adhesive or frictional engagement means, thus preventing transverse and/or longitudinal shrinkage during the perforation process. MacDuff also utilizes a heated air exhaust vent and a stream of cooling air to cool the surface of the support roll. The restraining system combined with the exhaust and cooling air system eliminate the need for a complex cooling system for the support roll/cylinder.

British Pat. No. GB 1,012,963 (Milner et al.) discloses a method and apparatus for flame perforating any suitable thermoplastic film capable of being softened and melted by heat. In GB 1,012,963 the tip of the flame just impinges on the outer surface of the plastic film as the film is slightly stretched and passes over a liquid coolant-chilled rotating cylinder, while the film is moving at a linear speed of approximately 10 yards per minute. The rotating cylinder has a pattern of indentations, which together with the flame promote the perforation of the film via the low heat conductivity of the air trapped behind the film in the indentations of the cylinder. The flame and burner in GB 1,012,963 are positioned at about mid-point of the segment of contact between the film with the cylinder surface.

British Patent Specification No. GB 1,083,847 discloses a method and apparatus for creating a net-like structure of polymer film by first forming protrusions in the film using heated pins on a nip roller, then biaxially stretching the film, flame perforating the protruding portions of the film as it passes over a chilled cylinder, using a process similar to GB 1,012,963 and finally biaxially stretching the film a second time.

U.S. Pat. No. 5,891,967 (Strobel et. al.) discloses a flame-treating method of modifying a polymeric substrate. The optimal distance of the flame to the film surface is generally less than 30 mm and can be as low as −2 mm, meaning approximately 2 mm of the tip of the luminous flame actually impinges the film surface, preferably between 0 mm and 10 mm, and more preferably between 0 mm and 2 mm U.S. Pat. No. 7,037,100 (Strobel et al.) describes an apparatus and methods for flame perforating films using the apparatus.

The porous backing comprises a thermoplastic, preferably as a thermoplastic film. Examples of suitable thermoplastics include polyolefins (e.g., polyethylene, polypropylene, polybutylene, or polymethylpentene), mixtures of polyolefin polymers and copolymers of olefins, polyolefin copolymers containing olefin segments (e.g., poly(ethylene-co-vinyl acetate), or poly(ethylene-co-methyl methacrylate), poly (ethylene-co-acrylic acid)), polyesters (e.g., poly(ethylene terephthalate), poly(butylene phthalate), or poly(ethylene naphthalate)), polystyrenes, vinylics (e.g., plasticized polyvinyl chloride, poly(vinylidene dichloride), poly(vinyl acetate-co-vinyl alcohol), or poly(vinyl butyral), ether oxide polymers (e.g., poly(ethylene oxide) or poly(methylene oxide)), ketone polymers (e.g., polyetherketone (PEK) or polyetheretherketone (PEEK)), polyimides; mixtures thereof, or copolymers thereof. Useful thermoplastic films, and their corresponding porous backings, may comprise a laminate to two or more thermoplastic polymer films. Likewise, useful thermoplastic films, and their corresponding porous backings, may comprise a primer-coated thermoplastic film. In the case of laminate and primed backings, the film is considered to be oriented if any layer of the backing is oriented.

The porous backing is oriented, preferably biaxially oriented. Preferably, the porous backing is made of oriented polymers and more preferably, biaxially oriented polymers. Biaxially oriented polypropylene (BOPP) is commercially available from several suppliers including: ExxonMobil Chemical Company (Houston, Texas); Continental Polymers (Swindon, United Kingdom); Kaisers International Corporation (Taipei City, Taiwan), and PT Indopoly Swakarsa Industry (ISI) (Jakarta, Indonesia). Other examples of suitable oriented polymer films are taught in U.S. Pat. No. 6,635,334 (Jackson et al.). In some embodiments, the porous backing may consist of a biaxially oriented PET film with a substantially unoriented coating of a copolymer of polyethylene, such as poly(ethylene-co-acrylic acid).

Porous coated abrasive articles according to the present disclosure may be made by a process in which a precursor abrasive layer comprising a slurry of abrasive particles dispersed in a curable binder precursor is coated on an oriented porous backing, for example, as described above.

Any suitable method to coat the precursor abrasive layer on the porous backing may be used including, for example, roll coating, gravure coating, knife coating, bar coating, screen printing, or curtain coating.

The precursor abrasive layer may comprise a slurry comprising a polymerizable binder precursor, optional surfactant, and abrasive grains. In this embodiment, the slurry is typically then cured/polymerized (e.g., by exposure to heat and/or actinic radiation) after coating on the porous backing.

Examples of binder precursors include phenolic resins, one-part and two-part urethane resins, hide glue, acrylic monomers and oligomers, urea-formaldehyde resins, aminoplast resins, cyanate resins, isocyanurate resins, vinyl ethers, melamine-formaldehyde resins, epoxy resins, latexes, and combinations thereof. As is well known in the art, catalysts, initiators, and/or curatives may be used in combination with binder precursors, typically in an at least an effective amount to cause curing.

Suitable abrasive particles include, for example, any known abrasive particles or materials commonly used in abrasive articles. Examples of useful abrasive particles include those comprising fused aluminum oxide, heat treated aluminum oxide, white fused aluminum oxide, black silicon carbide, green silicon carbide, titanium diboride, boron carbide, tungsten carbide, titanium carbide, diamond, cubic boron nitride, garnet, fused alumina zirconia, sol gel abrasive particles, silica, iron oxide, chromia, ceria, zirconia, titania, silicates, metal carbonates (such as calcium carbonate (e.g., chalk, calcite, marl, travertine, marble and limestone), calcium magnesium carbonate, sodium carbonate, magnesium carbonate), silica (e.g., quartz, glass beads, glass bubbles and glass fibers), silicates (e.g., talc, clays, (montmorillonite) feldspar, mica, calcium silicate, calcium metasilicate, sodium aluminosilicate, sodium silicate), metal sulfates (e.g., calcium sulfate, barium sulfate, sodium sulfate, aluminum sodium sulfate, aluminum sulfate), gypsum, aluminum trihydrate, graphite, metal oxides (e.g., tin oxide, calcium oxide), aluminum oxide, titanium dioxide and metal sulfites (e.g., calcium sulfite), metal particles (e.g., tin, lead, copper), plastic abrasive particles formed from a thermoplastic material, and combinations thereof. The abrasive particles may also be agglomerates or composites that include additional components, such as, for example, a binder. Criteria used in selecting abrasive particles used for a particular abrading application typically include: abrading life, rate of cut, substrate surface finish, grinding efficiency, and product cost.

The abrasive particles may be the result of a crushing operation (e.g., crushed abrasive particles that have been sorted for shape and size) or the result of a shaping operation (i.e., shaped abrasive particles) in which an abrasive precursor material is shaped (e.g., molded), dried, and converted to ceramic material. Combinations of abrasive particles resulting from crushing with abrasive particles resulting from a shaping operation may also be used. The abrasive particles may be in the form of, for example, individual particles, agglomerates, composite particles, and mixtures thereof.

The precursor abrasive layer and/or abrasive layer may further comprise optional additives such as abrasive particle surface modification additives, coupling agents, plasticizers, fillers, expanding agents, fibers, antistatic agents, initiators, suspending agents, photosensitizers, lubricants, wetting agents, surfactants, pigments, dyes, UV stabilizers, and suspending agents. The amounts of these materials are selected to provide the properties desired.

The selection of curable binder precursors, abrasive particle, curing conditions, basis weight of the abrasive layer will typically depend on the porous backing and the intended use, and areas within the capabilities of those having ordinary skill in the art.

In some embodiments, the abrasive layer may comprise shaped abrasive composites comprising abrasive particles (typically having minute size) retained in a binder. In many cases, the shaped abrasive composites are precisely-shaped, for example, according to various geometric shapes (e.g., pyramids) and resulting from a molding process. Examples of such abrasive articles include those marketed under the trade designation "TRIZACT" by 3M Company, St. Paul, Minnesota.

Details concerning such abrasive articles having precisely-shaped abrasive composites, and methods for their manufacture may be found, for example, in U.S. Pat. No. 5,152,917 (Pieper et al.); U.S. Pat. No. 5,435,816 (Spurgeon et al.); U.S. Pat. No. 5,672,097 (Hoopman); U.S. Pat. No. 5,681,217 (Hoopman et al.); U.S. Pat. No. 5,454,844 (Hibbard et al.); U.S. Pat. No. 5,851,247 (Stoetzel et al.); U.S. Pat. No. 6,139,594 (Kincaid et al.), and U.S. Pat. No. 8,038,750 (Woo et al.).

In another embodiment, the precursor abrasive layer can be deposited on the porous backing in a patterned manner (e.g., by screen or gravure printing), partially polymerized to render at least the surface of the coated slurry plastic but non-flowing, a pattern embossed upon the partially polymerized slurry formulation, and subsequently further polymerized (e.g., by exposure to an energy source) to form a plurality of shaped abrasive composites affixed to the backing. Such embossed structured abrasive articles prepared by this and related methods are described, for example, in U.S. Pat. No. 5,833,724 (Wei et al.); U.S. Pat. No. 5,863,306 (Wei et al.); U.S. Pat. No. 5,908,476 (Nishio et al.); U.S. Pat. No. 6,048,375 (Yang et al.); and U.S. Pat. No. 6,293,980 (Wei et al.); and U.S. Pat. Appl. Pub. No. 2001/0041511 (Lack et al.).

The optional porous adhesive layer may comprise a pressure-sensitive adhesive layer, a hot-melt adhesive layer, or a combination of the two, for example. Pressure-sensitive adhesives (e.g., acrylic pressure-sensitive adhesives) and/or hotmelt adhesives may be applied in (e.g., screen-printed or spray coated) in a porous pattern that permits airflow through the porous adhesive layer, for example.

In some embodiments, a hot-melt adhesive may be laminated to the oriented thermoplastic polymer film prior to flame-perforation. In such embodiments, the composite film is processed as a unitary polymer film. Either side of the composite film may be cooled by the contact roll during flame perforation. After flame-perforation both the backing and the adhesive layer will be porous.

The optional porous attachment interface layer may provide an adhesive or a mechanical attachment to a backup pad attached to a power driven tool and also allows air to pass through. In some embodiments, the porous attachment layer comprises a porous pressure-sensitive adhesive film. In some embodiments, the porous attachment interface layer may comprise a loop portion or a hook portion of a two-part mechanical engagement system.

In some embodiments, the porous attachment interface layer comprises a nonwoven, woven, or knitted loop material. The loop material may be used to affix the abrasive article to a back-up pad having a complementary mating component.

Suitable materials for a looped porous attachment interface layer may include both woven and nonwoven materials. Woven and knit porous attachment interface layer materials may have loop-forming filaments or yarns included in their fabric structure to form upstanding loops for engaging hooks. Nonwoven loop attachment interface layer materials may have loops formed by the interlocking fibers. In some nonwoven loop attachment interface layer materials, the loops are formed by stitching a yarn through the nonwoven web to form upstanding loops.

Useful nonwovens suitable for use as a loop porous attachment interface layer include, for example, airlaids, spunbonds, spunlaces, bonded melt blown webs, and bonded carded webs. The nonwoven materials may be bonded in a variety of ways known to those skilled in the art including, for example, needle-punching, stitchbonding, hydroentangling, chemical bonding, thermal bonding, and combinations thereof. The woven or nonwoven materials used may be made from natural fibers (e.g., wood or cotton fibers), synthetic fibers (e.g., polyester or polypropylene fibers) or combinations of natural and synthetic fibers. In some embodiments, the porous attachment layer comprises nylon, polyester or polypropylene.

In some embodiments, a loop porous attachment layer having an open structure that does not significantly interfere with the flow of air through it is selected. In some embodiments, the porous attachment interface layer material is selected, at least in part, based on the porosity of the material.

In some embodiments, the porous attachment interface layer comprises a hook material. The material used to form the hook material useful in the abrasive article may be made in one of many different ways known to those skilled in the art. Several suitable processes for making hook material useful in making porous attachment interface layers include, for example, methods described in U.S. Pat. No. 5,058,247 (Thomas et al.); U.S. Pat. No. 4,894,060 (Nestegard); U.S. Pat. No. 5,679,302 (Miller et al.); and U.S. Pat. No. 6,579,161 (Chesley et al.).

The hook material may be a porous material such as, for example the polymer netting material reported in U.S. Pat. Appln. Publ. No. 2004/0170801 (Seth et al.). In other embodiments, the hook material may be apertured to allow air to pass through. Apertures may be formed in the hook material using any methods known to those skilled in the art. For example, the apertures may be cut from a sheet of hook material using, for example, a die, laser, or other perforating instruments known to those skilled in the art. In other embodiments, the hook material may be formed with apertures.

Figure 2:
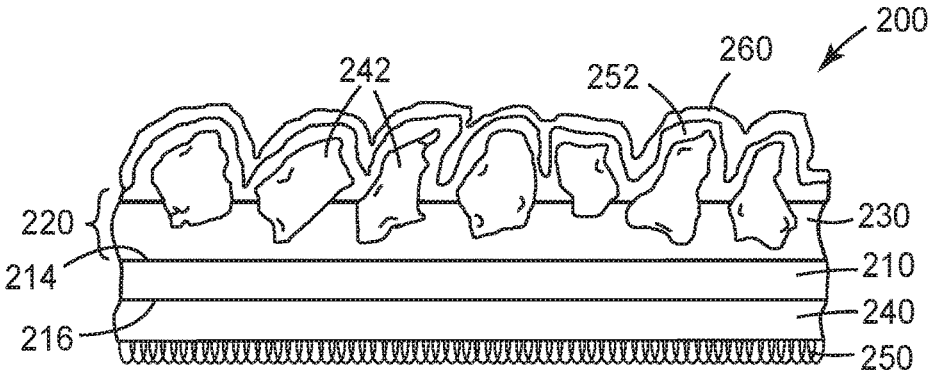
FIG. 2 is a schematic side view of an exemplary porous coated abrasive article 200 having make and size layers.

In some preferred embodiments, the abrasive layer comprises make and size layers. Referring now to FIG. 2, an exemplary coated abrasive article 200 comprises porous oriented thermoplastic film backing 210. Porous oriented thermoplastic film backing 210 has first and second major surfaces (214, 216). Abrasive layer 220 comprises make layer 230, size layer 252, and abrasive particles 242 which are partially embedded in make layer 230. Size layer 252 overlays make layer 230 and abrasive particles 242. Optional supersize layer 260 overlays size layer 252. For clarity, openings extending through the body of the coated abrasive article are not shown in FIG. 2, but they are present, for example, as shown in FIG. 1. Optional porous adhesive layer 240 is disposed on the second major surface 216 of the porous backing. Optional porous attachment interface layer 250 (shown as a looped fabric) is adhesively bonded to optional porous adhesive layer 240.

The abrasive layer can be formed by coating a curable make layer precursor onto a major surface of the backing and optionally partially curing it. Then, abrasive particles are applied and embedded in the optionally partially cured make layer precursor, and optionally the make layer precursor is at least partially (further) cured. Next a size layer precursor is coated over the partially cured make layer and abrasive particles, and the assembly (make and size layer precursors) is at least sufficiently cured to be useful for its intended abrading purpose. Finally a supersize layer precursor can be applied over the size layer, if desired.

The make layer precursor may comprise, for example, glue, phenolic resin, aminoplast resin, urea-formaldehyde resin, melamine-formaldehyde resin, urethane resin, free-radically polymerizable polyfunctional (meth)acrylate (e.g., aminoplast resin having pendant α,β-unsaturated groups, acrylated urethane, acrylated epoxy, acrylated isocyanurate), epoxy resin (including bis-maleimide and fluorene-modified epoxy resins), isocyanurate resin, and mixtures thereof. The make layer precursor may be applied by any known coating method for applying a make layer precursor to a backing including roll coating, extrusion die coating, curtain coating, knife coating, gravure coating, spray coating, and the like.

The basis weight of the make layer utilized may depend, for example, on the intended use(s), type(s) of abrasive particles, and nature of the coated abrasive article being prepared, for example, in the range of from 1 gram per square meter (gsm), 2 gsm, 5 gsm, 10 gsm, or 15 gsm to 20 gsm, 25 gsm, 100 gsm, 200 gsm, 300 gsm, 400 gsm, or even 600 gsm although other amounts may also be used. Once the make layer precursor is coated on the backing, abrasive particles are applied to and embedded in the make layer precursor (e.g., by drop coating and/or electrostatic coating). The abrasive particles can be applied or placed randomly or in a precise pattern onto the make layer precursor.

Once the abrasive particles have been embedded in the make layer precursor, it is at least partially cured in order to preserve orientation of the mineral during application of the size layer precursor. Typically, this involves B-staging the make layer precursor, but more advanced cures may also be used if desired. B-staging may be accomplished, for example, using heat and/or light and/or use of a curative, depending on the nature of the make layer precursor selected.

Next, the size layer precursor is applied over the at least partially cured make layer precursor and abrasive particles.

The size layer can be formed by coating a curable size layer precursor onto a major surface of the backing. The size layer precursor may comprise, for example, glue, phenolic resin, aminoplast resin, urea-formaldehyde resin, melamine-formaldehyde resin, urethane resin, free-radically polymerizable polyfunctional (meth)acrylate (e.g., aminoplast resin having pendant α,β-unsaturated groups, acrylated urethane, acrylated epoxy, acrylated isocyanurate), epoxy resin (including bis-maleimide and fluorene-modified epoxy resins), isocyanurate resin, and mixtures thereof. The size layer precursor may be applied by any known coating method for applying a size layer to a backing, including roll coating, extrusion die coating, curtain coating, knife coating, gravure coating, spray coating, and the like.

The basis weight of the size layer will also necessarily vary depending on the intended use(s), type(s) of abrasive particles, and nature of the coated abrasive article being prepared, for example, in the range of from 1 gsm or 5 gsm to 300 gsm, 400 gsm, or even 500 gsm, although other amounts may also be used. The size layer precursor may be applied by any known coating method for applying a size layer precursor (e.g., a size coat) to a backing including, for example, roll coating, extrusion die coating, curtain coating, and spray coating.

Once applied, the size layer precursor, and typically the partially cured make layer precursor, are sufficiently cured to provide a usable coated abrasive article. In general, this curing step involves thermal energy, but this is not a requirement. Useful forms of thermal energy include, for example, heat and infrared radiation. Exemplary sources of thermal energy include ovens (e.g., festoon ovens), heated rolls, hot air blowers, infrared lamps, and combinations thereof.

In addition to other components, binder precursors, if present, in the make layer precursor and/or presize layer precursor of coated abrasive articles according to the present disclosure may optionally contain catalysts (e.g., thermally activated catalysts or photocatalysts), free-radical initiators (e.g., thermal initiators or photoinitiators), and/or other curing agents in amounts effective to facilitate cure. Such catalysts (e.g., thermally activated catalysts or photocatalysts), free-radical initiators (e.g., thermal initiators or photoinitiators), and/or curing agents may be of any type known for use in coated abrasive articles including, for example, those described herein.

In addition to other components, curable binder precursors used in practice of the present disclosure including, for example, make and size layer precursors, may contain optional additives, for example, to modify performance and/or appearance. Exemplary additives include grinding aids, fillers, plasticizers, wetting agents, surfactants, pigments, coupling agents, fibers, lubricants, thixotropic materials, antistatic agents, suspending agents, and/or dyes.

Exemplary grinding aids, which may be organic or inorganic, include waxes, halogenated organic compounds such as chlorinated waxes like tetrachloronaphthalene, pentachloronaphthalene, and polyvinyl chloride; halide salts such as sodium chloride, potassium cryolite, sodium cryolite, ammonium cryolite, potassium tetrafluoroborate, sodium tetrafluoroborate, silicon fluorides, potassium chloride, magnesium chloride; and metals and their alloys such as tin, lead, bismuth, cobalt, antimony, cadmium, iron, and titanium; and the like. Examples of other grinding aids include sulfur, organic sulfur compounds, graphite, and metallic sulfides. A combination of different grinding aids can be used.

Exemplary antistatic agents include electrically conductive material such as vanadium pentoxide (e.g., dispersed in a sulfonated polyester), humectants, carbon black and/or graphite in a binder.

Examples of useful fillers include silica such as quartz, glass beads, glass bubbles and glass fibers; silicates such as talc, clays, (montmorillonite) feldspar, mica, calcium silicate, calcium metasilicate, sodium aluminosilicate, sodium silicate; metal sulfates such as calcium sulfate, barium sulfate, sodium sulfate, aluminum sodium sulfate, aluminum sulfate; gypsum; vermiculite; wood flour, aluminum trihydrate; carbon black; aluminum oxide; titanium dioxide; cryolite; chiolite; and metal sulfites such as calcium sulfite.

Optionally, a supersize layer may be applied to at least a portion of the abrasive layer (e.g., overlaying a size layer). If present, the supersize typically includes grinding aids and/or anti-loading materials. The optional supersize layer may serve to prevent or reduce the accumulation of swarf (the material abraded from a workpiece) between abrasive particles, which can dramatically reduce the cutting ability of the coated abrasive article. Useful supersize layers typically include a grinding aid (e.g., potassium tetrafluoroborate), metal salts of fatty acids (e.g., zinc stearate or calcium stearate), salts of phosphate esters (e.g., potassium behenyl phosphate), phosphate esters, urea-formaldehyde resins, mineral oils, crosslinked silanes, crosslinked silicones, and/or fluorochemicals. Useful supersize materials are further described, for example, in U.S. Pat. No. 5,556,437 (Lee et al.). The optional supersize can range from 1 gsm to 400 gsm, preferably 2 gsm to 300 gsm, and more preferably 2 gsm to 70 gsm, although other amounts may also be used. The supersize may contain a binder such as for example, those used to prepare the size or make layer, but it need not have any binder.

Further details concerning coated abrasive articles comprising an abrasive layer secured to a fabric backing, wherein the abrasive layer comprises abrasive particles and make, size, and optional supersize layers are well known, and may be found, for example, in U.S. Pat. No. 4,734,104 (Broberg); U.S. Pat. No. 4,737,163 (Larkey); U.S. Pat. No. 5,203,884 (Buchanan et al.); U.S. Pat. No. 5,152,917 (Pieper et al.); U.S. Pat. No. 5,378,251 (Culler et al.); U.S. Pat. No. 5,417,726 (Stout et al.); U.S. Pat. No. 5,436,063 (Follett et al.); U.S. Pat. No. 5,496,386 (Broberg et al.); U.S. Pat. No. 5,609,706 (Benedict et al.); U.S. Pat. No. 5,520,711 (Helmin); U.S. Pat. No. 5,954,844 (Law et al.); U.S. Pat. No. 5,961,674 (Gagliardi et al.); U.S. Pat. No. 4,751,138 (Bange et al.); U.S. Pat. No. 5,766,277 (DeVoe et al.); U.S. Pat. No. 6,077,601 (DeVoe et al.); U.S. Pat. No. 6,228,133 (Thurber et al.); and U.S. Pat. No. 5,975,988 (Christianson).

Objects and advantages of this disclosure are further illustrated by the following non-limiting examples, but the particular materials and amounts thereof recited in these examples, as well as other conditions and details, should not be construed to unduly limit this disclosure.

EXAMPLES

Unless otherwise noted, all parts, percentages, ratios, etc. in the Examples and the rest of the specification are by weight.

Example 1

A 2-mil (51-micron) thick biaxially-oriented polyester (PET) base film with an ethylene-acrylic acid copolymer heat-sealable layer available from 3M Company as SCOTCHPAK MA370W Polyester Packaging Film Laminate was flame-perforated as generally described in U.S. Pat. No. 7,037,100 (Getschel et al.) using the process conditions reported in Table 1, below.

TABLE 1

| | |
|---|---|
| Film | Scotchpak MA370W polyester packaging film laminate |
| Normalized Flame power | 13,500 btu/hr-in (5.60 MJ/hr-cm) |
| Air:fuel control ratio | 10 |
| Burner-to-film gap | 11 mm |
| Film Speed | 15 m/min |
| Roll cooling water | 60° F. (15.6° C.) |
| Shield cooling water, ° F., | 120° F. (48.9° C.) |
| Condensation nozzles, psi | 15 |
| Open | yes |
| Film side facing flame | polyester |

Onto the perforated film was coated an epoxy/acrylate make resin (generally as described as Epoxy Acrylate Make Coat Resin 2 in U.S. Pat. No. 9,393,673 B2 (Eilers et al.)) at a coat weight of 2.7-3.0 grains/24 in$^2$ (11.3-12.5 g/m$^2$). The make-coated PET film was placed on an electrostatic mineral coater and was coated at 40 grains/24 in$^2$ (170 g/m$^2$) with a prepared abrasive particle blend by mixing 10% of trigonal frustopyramidal abrasive particles prepared according to the disclosure of U.S. Pat. No. 8,142,531 (Adefris et al., draft angle between the sidewall and bottom of the mold was 98 degrees, 0.52 millimeter side length, 0.15 millimeter thickness) and 90% P80 grade alumina oxide abrasive mineral, obtained under the trade designation "ALODUR BFRPL" from Imerys Fused Minerals GmbH, Villach, Austria. The mineral-coated sheet was initially cured by passing through a UV processor having two "D" type bulbs, from Fusion Systems Inc., Gaithersburg, Maryland, at 600 W/in. (236 W/cm$^2$), a line speed of 50 ft/min (15.24 m/min), then thermally cured in an oven for 5 minutes at 140° C. After cooling to room temperature, the make/mineral coated sheet was coated with epoxy/acrylate size resin of an identical formulation as the make resin described above at a level of about 40 grains/24 in$^2$ (170 g/m$^2$) and determined visually via an optical microscope. The sized sheet was initially cured by passing through a UV processor having two "D" type bulbs, from Heraeus Noblelight, Gaithersburg, Maryland, at 600 W/in (236 W/cm2), a line speed of 50 ft/min (15.24 m/min), then thermally cured in an oven for 5 minutes at 140° C. Discs were made by spraying the backing film with Super 77 MULTIPURPOSE ADHESIVE from 3M Company, laminating the backing film to a polyester loop material, and die cut into 6 in (15.2 cm) diameter discs with no center hole.

Comparative Example 1

Example 1 was repeated, except that non-perforated SCOTCHPAK MA370W Polyester Packaging Film Laminate was used.

Testing

Coated abrasive discs prepared above were tested for breathability by blowing compressed air onto the samples and qualitatively feeling air passing through the discs. Example 1 discs containing the perforated backing were deemed breathable. The Comparative Example 1 disc had little or no air passing through the disc.

Coated abrasive discs prepared above were tested for dust extraction and cut. Example 1 discs exhibited increased dust extraction of more than 5 times as compared to Comparative Example 1 discs.

All cited references, patents, and patent applications in this application are incorporated by reference in a consistent manner. In the event of inconsistencies or contradictions between portions of the incorporated references and this application, the information in this application shall control. The preceding description, given in order to enable one of ordinary skill in the art to practice the claimed disclosure, is not to be construed as limiting the scope of the disclosure, which is defined by the claims and all equivalents thereto.

What is claimed is:

1. A porous coated abrasive article comprising:

a porous backing having opposed first and second major surfaces, wherein the porous backing comprises a porous oriented thermoplastic film, wherein the porous backing has a land portion and openings extending between the first and second major surfaces, wherein each opening has a respective area at the first major surface, wherein the openings have a number density of 5 to 4600 openings per square inch, and wherein the total area of the openings is from 1 to 90 area percent, based on the combined total areas of the land portion and the openings, wherein the openings are surrounded by respective ridges of the porous backing; and a porous abrasive layer disposed on the first major surface of the porous backing, wherein the porous abrasive layer comprises abrasive particles retained in a binder and has an abrading surface opposite the porous backing, and wherein the second major surface of the porous backing and the abrading surface are in fluid communication through at least some of the openings.

2. The porous coated abrasive article of claim 1, wherein the porous abrasive layer comprises make and size layers, wherein the make layer is disposed on the first major surface of the porous backing, wherein the abrasive particles are embedded in the make layer, and wherein the size layer is disposed over the make layer and abrasive particles.

3. The porous coated abrasive article of claim 1, further comprising a porous adhesive layer disposed on the second major surface of the porous backing, and wherein the porous adhesive layer has openings at least some of which are in at least partial registration with the openings extending between the first and second major surfaces of the porous backing.

4. The porous coated abrasive article of claim 3, further comprising a porous attachment interface layer adhered to the porous adhesive layer.

5. The porous coated abrasive article of claim 1, wherein the second major surface of the porous backing and the abrading surface are in fluid communication through at least 90 percent of the openings.

6. The porous coated abrasive article of claim 1, wherein the openings have a number density of 50 to 1000 openings per square inch.

7. The porous coated abrasive article of claim 1, wherein the total area of the openings is from 20 to 80 area percent, based on the combined total areas of the land portion and the openings.

8. The porous coated abrasive article of claim 1, wherein the porous backing taken as a whole has a basis weight that is the same as that of the land portion in regions of minimum thickness.

9. The porous coated abrasive article of claim 1, wherein the openings are formed by flame perforation.

10. The porous coated abrasive article of claim 1, wherein the porous abrasive layer extends over or into at least some of the openings.

11. A method of making a porous coated abrasive article, the method comprising:

providing a porous backing having opposed first and second major surfaces, wherein the porous backing comprises a porous oriented thermoplastic film, wherein the porous backing has a land portion and openings extending between the first and second major surfaces, wherein each opening has a respective area at the first major surface, wherein the openings have a number density of 5 to 4600 openings per square inch, and wherein the total area of the openings is from 1 to 90 area percent, based on the combined total areas of the land portion and the openings, wherein the openings are surrounded by respective ridges of the porous backing;

disposing a precursor abrasive layer on the first major surface of the porous backing, wherein the precursor abrasive layer comprises abrasive particles dispersed in a curable binder precursor; and at least partially curing the curable binder precursor to provide a binder thereby providing a porous abrasive layer having an abrading surface, wherein the second major surface of the porous backing and the abrading surface are in fluid communication through at least some of the openings.

12. The method of claim 11, wherein the porous abrasive layer comprises make and size layers, wherein the make layer is disposed on the first major surface of the porous backing, wherein the abrasive particles are embedded in the make layer, and wherein the size layer is disposed over the make layer and abrasive particles.

13. The method of claim 11, further comprising a porous adhesive layer disposed on the second major surface of the porous backing, and wherein the porous adhesive layer has openings at least some of which are in at least partial registration with the openings extending between the first and second major surfaces of the porous backing.

14. The method of claim 13, further comprising adhering a porous attachment interface layer to the porous adhesive layer.

15. The method of claim 11, wherein the second major surface of the porous backing and the abrading surface are in fluid communication through at least 90 percent of the openings.

16. The method of claim 11, wherein the openings have a number density of 50 to 1000 openings per square inch.

17. The method of claim 11, wherein the total area of the openings is from 20 to 80 area percent, based on the combined total areas of the land portion and the openings.

18. The method of claim 11, wherein the porous backing taken as a whole has a basis weight that is the same as that of the land portion in regions of minimum thickness of the porous backing.

19. The method of claim 11, wherein the openings are formed by flame perforation.

20. The method of claim 11, wherein the porous abrasive layer extends over or into at least some of the openings.

* * * * *